US010040678B2

(12) United States Patent
Gai

(10) Patent No.: US 10,040,678 B2
(45) Date of Patent: Aug. 7, 2018

(54) FILLING DEVICES FOR FILLING MACHINES FOR LEVEL FILLING OF BOTTLES AND FILLING MACHINES CONTAINING SUCH DEVICES

(71) Applicant: GAI MACCHINE IMBOTTIGLIATRICI S.p.A., Ceresole D'Alba (Cuneo) (IT)

(72) Inventor: Carlo Gai, Ceresole D'Alba (IT)

(73) Assignee: GAI MACCHINE IMBOTTIGLIATRICI S.P.A., Ceresole D'Alba (Cuneo) (IT)

( * ) Notice: Subject to any disclaimer, the term of this patent is extended or adjusted under 35 U.S.C. 154(b) by 0 days.

(21) Appl. No.: 14/767,969

(22) PCT Filed: Apr. 14, 2014

(86) PCT No.: PCT/IB2014/060699
§ 371 (c)(1),
(2) Date: Aug. 14, 2015

(87) PCT Pub. No.: WO2014/170812
PCT Pub. Date: Oct. 23, 2014

(65) Prior Publication Data

US 2016/0023877 A1 Jan. 28, 2016

(30) Foreign Application Priority Data

Apr. 15, 2013 (IT) ..... TO2013A0302

(51) Int. Cl.
*B67C 3/26* (2006.01)

(52) U.S. Cl.
CPC ..... *B67C 3/2617* (2013.01); *B67C 3/262* (2013.01); *B67C 2003/2651* (2013.01); *B67C 2003/2668* (2013.01)

(58) Field of Classification Search
CPC ..... B65B 3/10; B67C 2003/2651; B67C 2003/2668; B67C 3/2617; B67C 3/262
(Continued)

(56) References Cited

U.S. PATENT DOCUMENTS 3,834,428 A * 9/1974 Rademacher ..... B67C 3/2628 141/39
3,908,717 A * 9/1975 Rademacher ..... B67C 3/06 141/392
(Continued)

FOREIGN PATENT DOCUMENTS

EP 1995208 A1 11/2008
EP 2236454 A1 10/2010
(Continued)

*Primary Examiner* — Timothy L Maust
(74) *Attorney, Agent, or Firm* — Robert E. Alderson, Jr.

(57) ABSTRACT

Filling devices for lever filling of bottles with liquids are provided. Such devices may include a body having a vertical inner cavity, an outer tube which is fixed at the top to a bottom wall of a main vessel intended to contain the liquid with which the bottles are to be filled, extending through the inner cavity of the body and projecting downward from the body, an inner tube which is arranged coaxially with the outer tube, extending with a lower portion thereof inside the outer tube and projecting upward from the outer tube, so as to reach with its top end a level higher than the level of the liquid contained in the main vessel. Filling machines containing such devices are also provided.

8 Claims, 6 Drawing Sheets

(58) Field of Classification Search
USPC ..... 141/57
See application file for complete search history.

(56) References Cited

U.S. PATENT DOCUMENTS

| | | | | | |
|---|---|---|---|---|---|
| 5,474,113 | A * | 12/1995 | Rademacher | B67C 3/2608 | 141/116 |
| 5,564,481 | A * | 10/1996 | Clusserath | B67C 3/10 | 141/39 |
| 5,634,500 | A * | 6/1997 | Clusserath | B67C 3/10 | 141/44 |
| 6,023,910 | A * | 2/2000 | Lubus | B67B 3/2046 | 53/317 |
| 7,243,483 | B2 * | 7/2007 | Clusserath | B67C 3/281 | 141/290 |
| 7,647,950 | B2 * | 1/2010 | Clusserath | B67C 3/12 | 141/44 |
| 8,695,647 | B2 * | 4/2014 | Ruble | B67C 3/10 | 141/144 |
| 2001/0045242 | A1 * | 11/2001 | Clusserath | B67C 3/286 | 141/144 |
| 2005/0199314 | A1 * | 9/2005 | Ruble | B65B 39/004 | 141/146 |
| 2011/0197996 | A1 * | 8/2011 | Clusserath | B67C 3/001 | 141/311 R |
| 2014/0360624 | A1 * | 12/2014 | Clusserath | B67C 3/001 | 141/91 |
| 2015/0013833 | A1 * | 1/2015 | Clusserath | B67C 3/06 | 141/5 |
| 2016/0009533 | A1 * | 1/2016 | Clusserath | B67C 3/002 | 141/91 |
| 2016/0016774 | A1 * | 1/2016 | Clusserath | B67C 3/10 | 141/7 |
| 2016/0025267 | A1 * | 1/2016 | Clusserath | B67C 3/10 | 141/4 |
| 2016/0052765 | A1 * | 2/2016 | Clusserath | B67C 3/007 | 141/6 |

FOREIGN PATENT DOCUMENTS

| | | | |
|---|---|---|---|
| FR | 994101 | A | 11/1951 |
| FR | 2552749 | A1 | 4/1985 |
| GB | 1515804 | A | 6/1978 |
| IT | TO2012A000869 | A | 4/2014 |
| WO | 2014054027 | A | 4/2014 |

* cited by examiner

FILLING DEVICES FOR FILLING MACHINES FOR LEVEL FILLING OF BOTTLES AND FILLING MACHINES CONTAINING SUCH DEVICES

CROSS-REFERENCE TO RELATED APPLICATIONS

This application is a National Phase Application of PCT International Application No. PCT/IB2014/060699, International Filing Date, Apr. 14, 2014, claiming priority to Italian Patent Application No. TO2013A000302, filed Apr. 15, 2013, each of which is hereby incorporated by reference in its entirety.

FIELD OF THE INVENTION

The present invention relates in general to a filling machine for filling bottles with food liquids, such as in particular wine and beer, and more specifically to a filling device intended to be installed on such a machine.

BACKGROUND OF THE INVENTION

The filling of bottles is generally classified in two categories, i.e. level filling and volumetric filling, depending on the technology used to detect when the right amount of liquid supplied has been reached. In turn, level filling differs depending on the liquid to be processed. In the case of non-gaseous liquids filling is performed at atmospheric pressure or under a slight vacuum, in the case of gaseous liquids an isobaric filling is performed and in the case of viscous liquids filling is performed under conditions where there is a pressure difference, obtained by creation of high vacuum or by overpressure.

The filling device according to the present invention falls within the category of level-filling devices and allows filling with all the three above-mentioned categories of liquids (non-gaseous liquids, gaseous liquids and viscous liquids). In the following description reference will be made in particular to the operation of the filling device with gaseous liquids, and therefore to the isobaric filling mode.

FIG. 1 of the accompanying drawings shows an axially sectioned view of a known isobaric filling device (hereinafter simply referred to as filling device). The filling device is generally indicated 10 and basically comprises:

- a body 12 intended to be fixed to a bottom wall 14 of a vessel 16 of a filling machine, the body 12 having an inner cavity 18 which is open at the top and communicates at the bottom with the outside through a nozzle 20 with a conical cross-section which is fixed to the body 12 and the axis z of which is oriented vertically;
- a first tube, or outer tube, 24 which is fixed to the top part of the body 12 and is arranged coaxially with the nozzle 20, passing, in the assembled condition of the filling device on the filling machine, through a hole 22 in the bottom wall 14 of the vessel 16 and extending up to a certain distance from the bottom of the vessel;
- a second tube, or inner tube, 26 which is arranged coaxially with the nozzle 20 and the outer tube 24, extending inside the outer tube 24 and projecting from the bottom of the body 12 through the nozzle 20;
- a centring cone 28 which is arranged coaxially with the nozzle 20 and the inner tube 26 and is provided with a seal member 30 for sealing against the top end of the neck of a bottle (not shown) to be filled; and

- a valve assembly 32 comprising a plurality of valves 34 (in the example shown three valves) intended to be controlled by means of cams suitably configured to start and stop the various steps provided for by the bottle filling cycle.

The filling device 10 further comprises a closure member 36 (referred to below as first closure member) which is provided with a seal member 38 and is fixed to the inner tube 26, coaxially therewith, to cooperate with a conical surface portion 40 of the inner cavity 18 of the body 12. The inner tube 26, and together therewith the first closure member 36, is movable with respect to the assembly formed by the body 12 and by the outer tube 24 between a lowered position (shown in FIG. 1), in which the first closure member 36, by means of the seal member 38, closes off the passage from the inner cavity 18 to the nozzle 20, and a raised position (not shown), in which an annular passage is created between the first closure member 36 and the conical surface portion 40 of the inner cavity 18, through which passage the liquid flowing from the vessel 16, through one or more openings 42 provided in the outer tube 24, to the annular conduit 44 defined between the outer tube 24 and the inner tube 26 may flow out towards the nozzle 20 and from here into the bottle. The first closure member 36 is urged towards the raised position by a spring 46 arranged between a snap ring 48 mounted on the outer tube 24 and an abutment member 50 fixed to the top end of the inner tube 26.

The filling device 10 also comprises a further closure member 66 (referred to below as second closure member) which is positioned coaxially with the inner tube 26, above the latter, and is movable axially with respect to the inner tube 26 between an open position (position shown in FIG. 1), in which it is at a distance from the top end of the inner tube 26 and therefore leaves this tube open, and a closed position (not shown), in which it makes sealing contact with the top end of the inner tube 26 and therefore keeps this tube closed.

In the case of gaseous liquids, and more particularly in the case of sparkling wine, the bottle filling cycle with a filling device such as the known one shown in FIG. 1 typically comprises the steps described below.

First of all, the bottle to be filled is raised by means of a pneumatic piston so as to be pressed against the seal member 30 of the centring cone 28 until the centring cone 30 comes into abutment against the body 12 around the outlet section of the nozzle 20, so as to provide a perfect seal between the body and the bottle in order to contain the filling pressure.

This is followed by a deaeration step, during which the air contained inside the bottle is forced out of it by means of a liquid-ring vacuum pump (not shown).

Then the bottle is put in communication with the portion of the vessel 16 positioned above the level L of the liquid through the inner tube 26 (with the second closure member 66 in the open position) in order to carry out the pressure compensation step, during which the gas under pressure contained in the vessel passes from the latter into the bottle until the gas contained in the vessel and the gas contained in the bottle are at the same pressure.

Once a balance between the pressure of the gas in the vessel 16 and the pressure of the gas in the bottle is reached, the spring 46 causes raising of the inner tube 26, and together therewith of the first closure member 36, thus allowing the liquid contained in the vessel to fill the bottle passing through the annular passage defined between the nozzle 20 and the inner tube 26 (filling step). During filling of the bottle with the liquid, the gas previously introduced into the bottle returns into the top portion of the vessel 16 flowing inside the inner tube 26 and leaving this tube from the top end thereof, with the second closure member 66 remaining in the open position. When the level of the liquid in the bottle has reached a given predefined value, the assembly formed by the inner tube 26 and by the first closure member 36 is moved into the lowered position so as to interrupt the flow of the fluid from the vessel into the bottle.

The filling step is then followed by a levelling step, during which gas under a slight overpressure (about 0.2 bar greater than the pressure in the bottle) is introduced into the bottle through the annular passage defined between the nozzle 20 and the inner tube 26, with the first closure member 36 remaining in the lowered position, whereby the excess liquid contained in the bottle, i.e. the liquid which is situated above the bottom end of the inner tube 26, is conveyed back into the vessel 16 through this tube.

This is followed by a degassing step, during which the inside of the bottle is put in communication with the outside so as to eliminate slowly the overpressure produced during the previous step.

Finally, the pneumatic piston is lowered so as to allow removal of the bottle which has now been filled.

A further known example of a filling device, that forms the subject-matter of Italian patent application No. ITTO20120869 in the Applicant's name, is shown in the axially sectioned view of FIG. 2 and in the view on an enlarged scale of FIG. 3 of the appended drawings, in which parts and elements identical or corresponding to those of FIG. 1 have been given the same reference numerals.

With reference to FIGS. 2 and 3, the filling device known from the above-mentioned Italian patent application is generally indicated 10 and basically comprises:

- a body 12 having an inner cavity 18 of cylindrical shape which extends vertically through the entire body 12;
- an outer tube 24 with a vertical axis (indicated z) which is fixed at the top to a bottom wall 14 of a vessel 16 of the filling machine, extends through the inner cavity 18 of the body 12 and projects downwards relative to the body 12;
- an inner tube 26 which is arranged coaxially with the outer tube 24 and extends partly (bottom part) inside the outer tube 24 and partly (top part) inside the vessel 16, after passing through a hole 22 provided in the bottom wall 14, reaching with its top end a level above the level L of the liquid in the vessel 16;
- a centring cone 28 which is arranged coaxially with the two tubes, i.e. the outer tube 24 and the inner tube 26, and is provided with a seal member 30 for sealing against the top end of the neck of a bottle (not shown) to be filled; and
- a valve assembly 32 comprising a plurality of pneumatically operated valves, in particular four pneumatically operated valves 34*a*, 34*b*, 34*c* and 34*d*, configured to start and stop, according to predetermined operating modes, the various steps provided for by the bottle filling cycle.

An annular conduit 44 is therefore defined between the outer tube 24 and the inner tube 26 and extends up to the bottom end of the outer tube, the liquid contained in the vessel 16 being able to flow through the annular conduit downwards to fill a bottle. The liquid flow along the annular conduit 44 is controlled by a first closure member 36 provided with a seal member 38. The first closure member 36 is fixed to the inner tube 26, coaxially therewith, at a bottom end portion thereof which projects downwards from the outer tube 24, in order to cooperate with the bottom end of the outer tube 24. The inner tube 26, along with the first closure member 36, is movable with respect to the outer tube 24 between a raised position (shown in FIG. 2), in which the first closure member 36, by means of the seal member 38, closes the annular conduit 44 at the bottom, thus preventing the liquid contained in the vessel 16 from flowing out of the filling device 10 and filling the bottle, and a lowered position (shown in FIG. 3), in which the first closure member 36 leaves the annular conduit 44 open at the bottom, thus allowing the liquid contained in the vessel 16 to flow out of the filling device 10 and fill the bottle. Still with reference to FIG. 3, the first closure member 36 has, below the seal member 38, a hole 52 that is formed in particular as an oblique hole and has the function of putting the inner tube 26 into communication with the outside, in particular for the passage of gas from the vessel to the bottle and vice versa, as will be explained more clearly further on.

The centring cone 28 is mounted on a support plate 54 which is fixed to the bottom end of a pair of rods 56 (only one of which is visible in the cross-sectional view of FIG. 2) arranged with their axis parallel to and at a distance from the axis z of the centring cone and of the outer tube 24 and inner tube 26. Each rod 56 is guided slidably in a respective cylinder 58 fixed to the vessel 16, in particular to the bottom wall 14 of the latter, so as to allow the centring cone 28 to move vertically relative to the vessel 16, as well as relative to the body 12 and to the outer tube 24 (which are drivingly connected to the vessel). In particular, the travel of the vertical movement of the centring cone 28 is such as to allow the latter to come in abutment against the bottom side of the body 12, this being a necessary condition for the device to be able to perform filling of a bottle in isobaric mode. A proximity sensor 60 that detects the presence of the bottle beneath the filling device 10 to start the filling process and a pressure sensor 84 that measures the pressure reached inside the bottle are mounted so as to be drivingly connected to the body 12.

The filling device 10 further comprises an actuation unit 62 which is associated with the top end of the inner tube 26 to control the vertical movement of the latter, as well as that of the first closure member 36 with the associated seal member 38, between the lowered position and raised position defined above and to control the flow of the gas through this tube. The actuation unit 62 is mounted on a cover 64 of the vessel 16 and comprises a first linear actuator and a second linear actuator which are mounted in series with each other, wherein the first linear actuator is able to control the vertical movement of the inner tube 26 and the second linear actuator is able to control the vertical movement of a second closure member 66 to open or close the top end of the inner tube 26. The first linear actuator is preferably formed as a double-acting pneumatic cylinder and comprises a cylinder 68 fixed to the cover 64 of the vessel 16 coaxially with the inner tube 26 and a piston 70 mounted slidably in the cylinder 68. The piston 70 has a stem 72 which projects downwards from the cylinder 68 and is fixed to the top end of the inner tube 26 so as to be drivingly connected therewith during its vertical translational movement. The second linear actuator is also preferably formed as a double-acting pneumatic cylinder and comprises a cylinder 74, which is connected to the piston 70 of the first linear actuator so as to be drivingly connected with the latter during its vertical translational movement, and a piston 76 mounted slidably in the cylinder 74. The piston 76 has a stem 78 which projects downwards from the cylinder 74 and extends through a coaxial cylindrical cavity 80 formed in the stem 72 of the piston 70 of the first linear actuator. The closure member 66 is fixed to the bottom end of the stem 78 and is therefore drivingly connected with the stem 78 in its vertical translational movement.

The operation of the filling device 10 of FIGS. 2 and 3, with reference to the filling of a bottle with a sparkling wine according to the isobaric filling mode, takes place as follows.

First of all the bottle to be filled is raised by means of a pneumatic piston (not shown) to be urged against the seal member 30 of the centring cone 28 until the centring cone 30 comes into abutment against the bottom side of the body 12, so as to provide a perfect seal between the body and the bottle to limit the filling pressure. The proximity sensor 60 detects the presence of the bottle underneath the filling device 10 and starts the filling process.

The pneumatically operated valve 34*a* is then operated to put the inside of the bottle in communication with a vacuum circuit 82*a* and thus start a deaeration step, during which the air contained inside the bottle is expelled therefrom. Once the deaeration step has been completed, the pneumatically operated valve 34*a* is operated to close the vacuum circuit 82*a*.

This is followed by a pressure compensation step, during which the gas present in the vessel 16 and the gas present in the bottle are set to the same pressure. For this purpose, the pneumatically operated valve 34*b* is operated to put the inside of the bottle in communication with the top part of the vessel 16, i.e. the part of the vessel situated above the level L of the liquid, by means of a circuit 82*b*. During the pressure compensation step, the pressure sensor 84 measures the pressure reached inside the bottle. In the event of bottle breaking or bursting, the pressure sensor 84 indicates that the compensation pressure has not been reached and the machine interrupts the filling cycle. Once the pressure compensation step has been completed, the pneumatically operated valve 34*b* is operated to close the circuit 82*b*.

An overpressure step is then carried out, during which a certain overpressure is created in the bottle. For this purpose, the pneumatically operated valve 34*c* is operated to open a circuit 82*c* through which the inside of the bottle is brought to a pressure which is slightly higher (for example, about 0.2 bar higher) than the pressure present in the vessel. Then the pneumatically operated valve 34*c* is closed and the closure member 66 is raised by means of the second pneumatic cylinder (cylinder 74 and piston 76) so as to put the inner tube 26 in communication with the part of the vessel 16 above the level L of the liquid contained therein. As a result of the overpressure present inside the bottle, any liquid droplets remaining on the inner wall of the inner tube 26 are conveyed into the vessel 16. In this way, these droplets are prevented from falling into the bottle and therefore giving rise to the possible formation of foam. The overpressure step may be omitted should foam formation conditions not exist.

At this point a filling step is performed, during which the liquid contained in the vessel 16 is introduced into the bottle up to a predetermined level. For this purpose the first pneumatic cylinder (cylinder 68 and piston 70) is operated to cause the displacement of the assembly formed by the inner tube 26 and by the first closure member 36 into the lowered position and therefore allow the liquid to fall by gravity from the vessel 16 into the bottle via the annular conduit 44. During the filling step, as the liquid gradually fills the bottle, the gas already present in the bottle returns back into the vessel 16 via the hole 52 and the inner tube 26. The filling step ends when the liquid in the bottle reaches a level such as to obstruct the hole 52 provided in the first closure member 36. It will be noted in this connection that in the filling device 10 according to the invention the final level of the liquid in the bottle is defined by the vertical position of the first closure member 36 inside the bottle. In order to vary the filling level, it is therefore sufficient to vary the position of the body 12. This position defines in fact the stop position of the centring cone 28 when the bottle is urged upwards against said centring cone at the start of the filling cycle, and therefore a variation in this position results in a corresponding variation in the relative position of the first closure member 36 with respect to the bottle. Since the body 12 is preferably mounted on the support flange 86, which is common to all the filling devices of the machine, the adjustment of the filling level is carried out simultaneously for all the filling devices installed on the machine. Moreover, the adjustment of the filling level may be carried out while the machine is in operation.

Once the predefined filling level has been reached, the first pneumatic cylinder 68, 70 is operated to cause the displacement of the assembly formed by the inner tube 26 and the first closure member 36 into the raised position, so as to close the annular conduit 44 at the bottom. At this point an emptying step is performed, during which the liquid present in the inner tube 26 is conveyed back into the vessel 16. For this purpose, the pneumatically operated valve 34*c* is opened and by means of the circuit 82*c* causes the pressure inside the bottle to become slighter higher than the pressure present in the vessel (about 0.2 bar higher) so as to convey the liquid present in the inner tube 26 into the vessel 16. Depending on the liquid used, this emptying step may also be omitted. Once the emptying step has been completed or, in case this step is not carried out, once the filling step has been completed, the second pneumatic cylinder 74, 76 is operated to cause lowering of the second closure member 66 and therefore closure of the inner tube 26 also at its top end.

Finally, a degassing step is carried out, during which the pneumatically operated valve 34*d* is opened and closed in succession, thus putting alternately the inside of the bottle in communication with a circuit 82*d* which is at atmospheric pressure in order to eliminate gradually the pressure present in the bottle and therefore limit the formation of foam.

By virtue of the fact that the first closure member is provided at the bottom end of the inner tube and cooperates with the bottom end of the outer tube, with the known filling device shown in FIGS. 2 and 3 closure of the liquid flow passage occurs in the vicinity of the hole via which the inner tube communicates with the inside of the bottle, thus making it possible to obtain a greater precision in the filling level and therefore avoid having to carry out the levelling step, which is instead necessary with a filling device such as that according to FIG. 1.

SUMMARY OF THE INVENTION

It is an object of the present invention to provide an improved filling device for level filling of bottles with respect to the prior art described above.

This and other objects are fully achieved according to the present invention by filling devices as described and claimed herein.

In short, the invention is based on the idea of providing a filling device in which the second closure member is arranged in the vicinity of the bottom end of the inner tube so as to open/close this tube at the bottom, instead of at the top.

By virtue of this arrangement of the second closure member, the filling device of the invention allows to obtain a high degree of precision in the filling level without having to carry out a step for emptying the inner tube by which, in the known filling devices, the liquid present in the inner tube is conveyed back into the vessel. In fact, as will result more clearly from the description below, once the inner tube has been closed at the bottom by means of the second closure member, any liquid contained inside the tube itself at the end of the filling step cannot return into the bottle and therefore cannot modify the (correct) filling level reached. Since the aforementioned emptying step can be avoided, an (albeit minimum) amount of liquid is not conveyed back into the vessel and therefore the risk of contamination of the product in the vessel is further reduced.

Moreover, with the filling device according to the invention the degassing step (i.e. the step of the filling cycle during which the inside of the bottle is put into communication alternately with the atmospheric pressure in order to gradually eliminate the pressure present in the bottle and therefore reduce the formation of foam) can be carried out in a better way than in the prior art on difficult products such as for example sparkling wine, beer, etc., by virtue of the fact that providing the second closure member at the bottom end of the inner tube allows to exclude the volume of gas contained in the inner tube from the degassing step, whereby the volume of gas to be degassed with the filling device of the invention is nearly half the volume of gas to be degassed with the known filling devices in which the second closure member is placed at the top end of the inner tube.

With the second closure member being placed in the vicinity of the bottom end of the inner tube, the first closure member, i.e. the closure member that controls opening and closing of the annular conduit defined between the inner tube and the outer tube, may be indifferently arranged also at the bottom end of the inner tube, as in the known embodiment shown in FIGS. 2 and 3, or in an intermediate portion of the inner tube, as in the known embodiment shown in FIG. 1.

Further features and advantages of the present invention will result more clearly from the following detailed description provided purely by way of non-limiting examples, with reference to the attached drawings.

DETAILED DESCRIPTION

Figure 2:
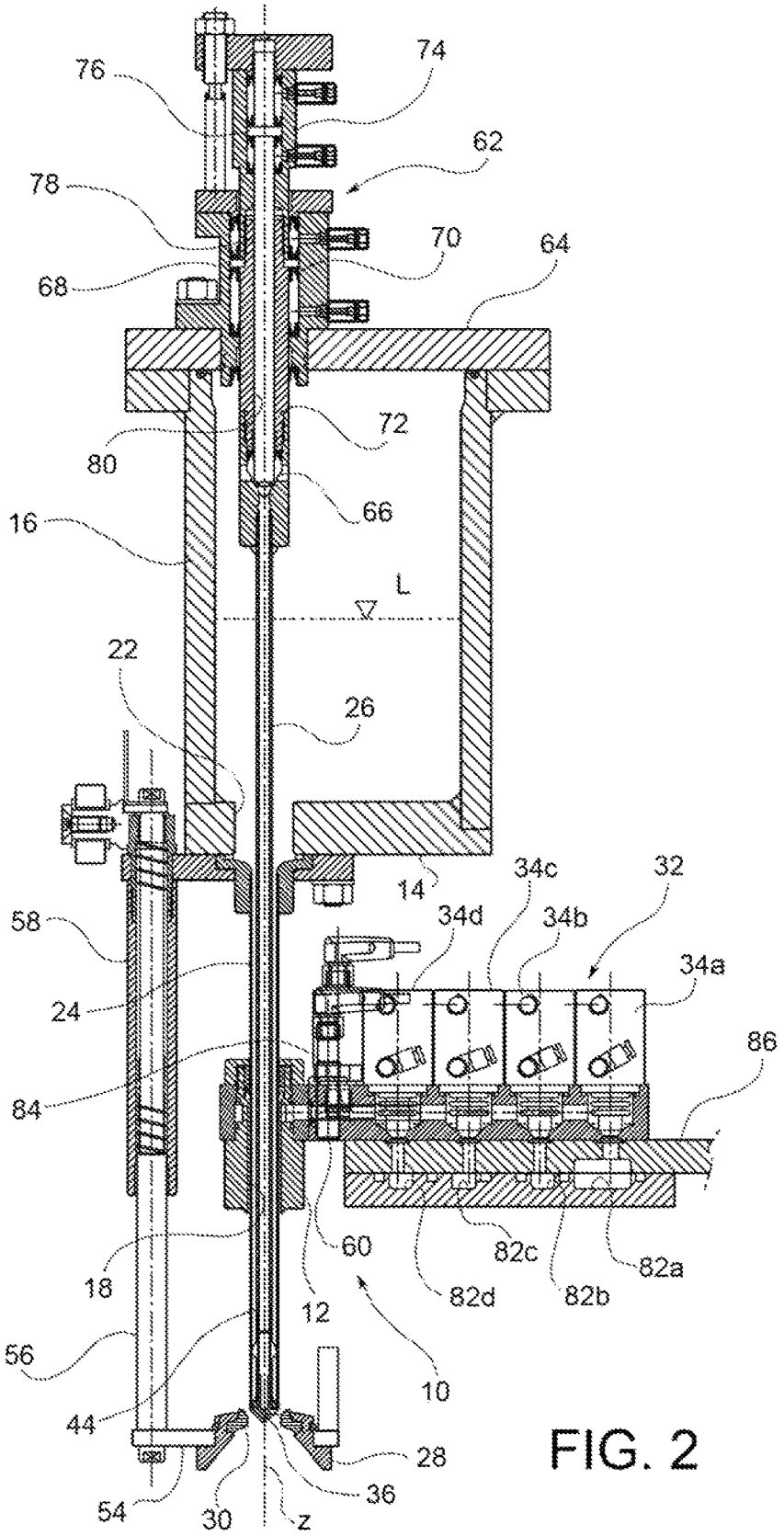
FIG. 2 is an axially sectioned view of a filling device for filling machines according to a further known embodiment.
Figure 3:
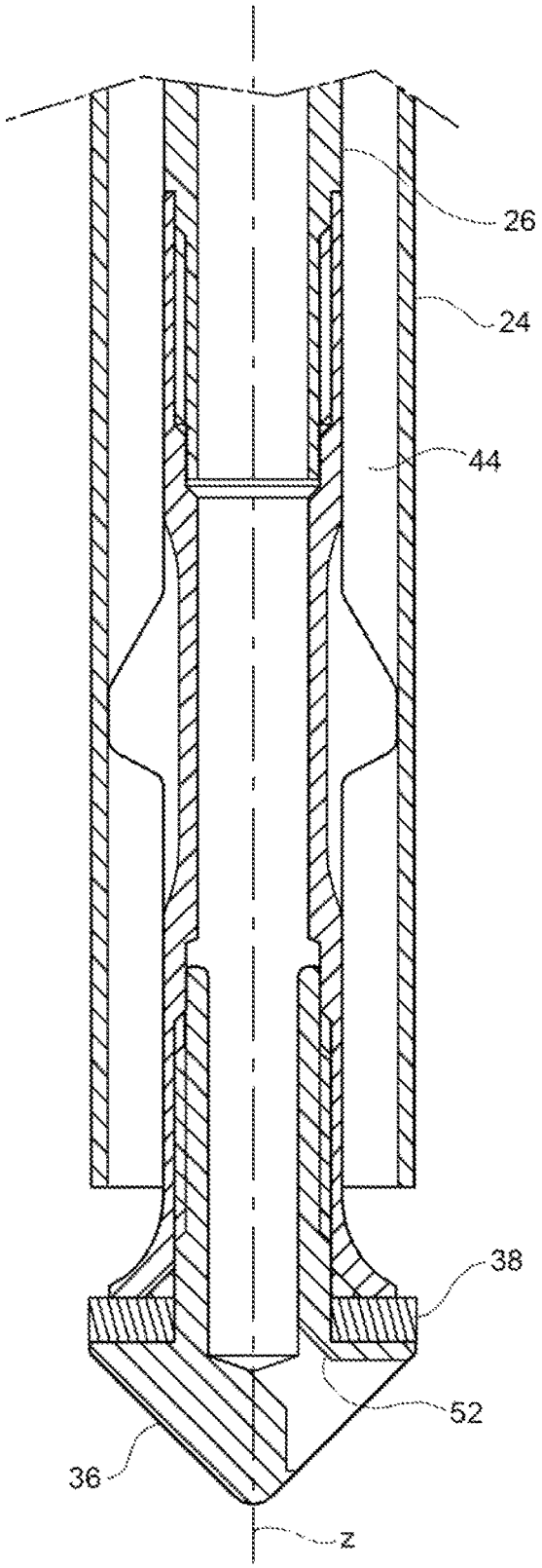
FIG. 3 shows, on an enlarged scale, the bottom portion of the known filling device of FIG. 2.
Figure 4:
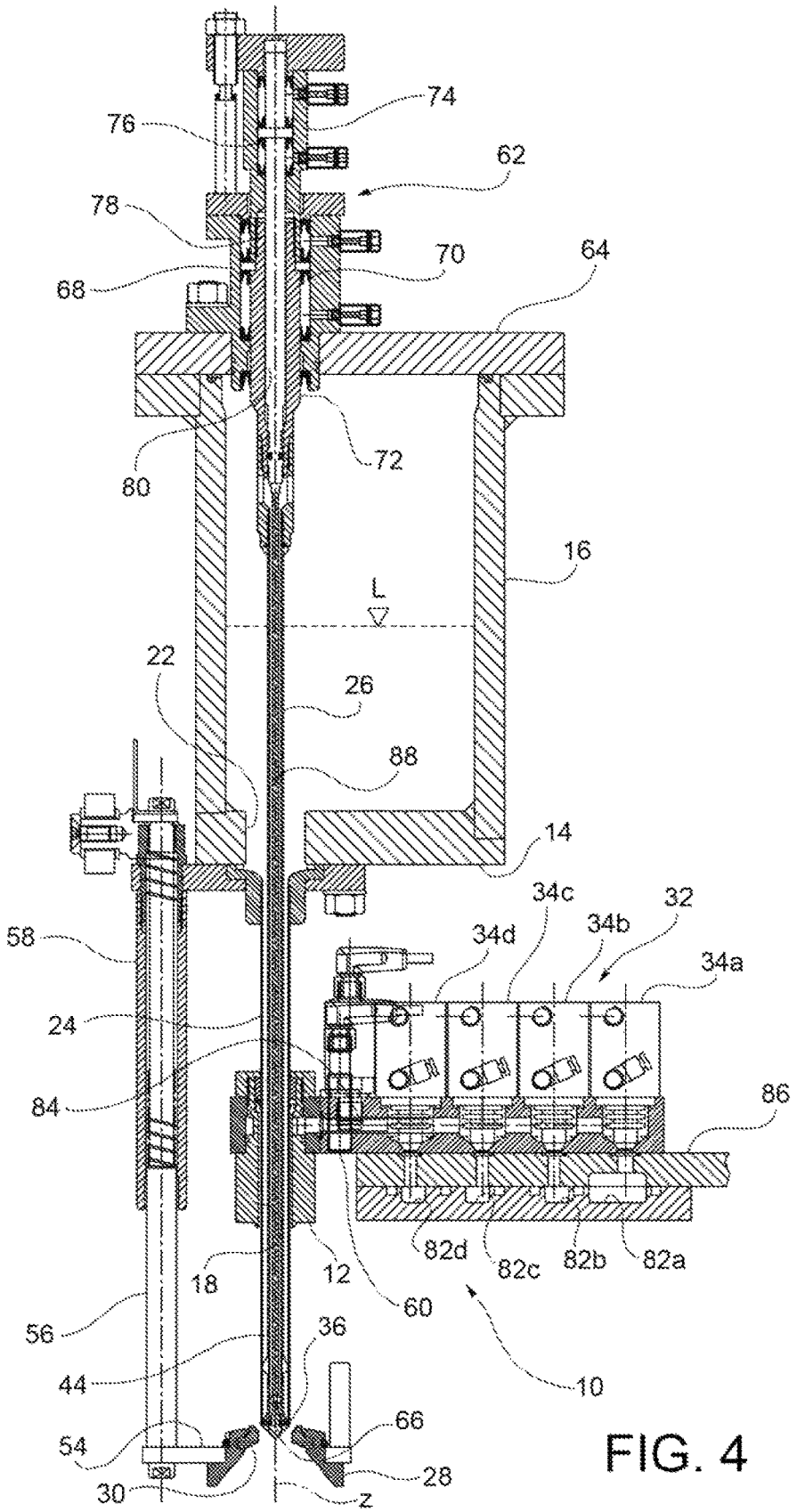
FIG. 4 is an axially sectioned view of a filling device for filling machines according to an embodiment of the present invention.
Figure 5:
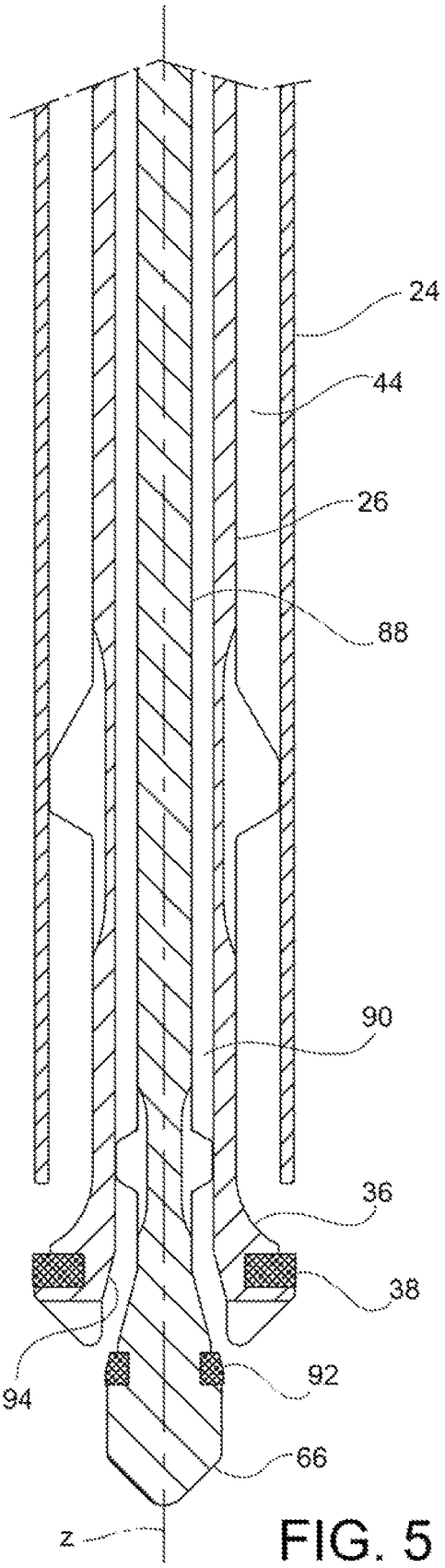
FIG. 5 shows, on an enlarged scale, the bottom portion of the filling device of FIG. 4.

The embodiment of the filling device for filling machines according to the present invention, as shown in FIGS. 4 and 5, has a structure and operation corresponding to a great extent to those of the known filling device shown in FIGS. 2 and 3. For the sake of conciseness, therefore, only the features of the filling device of FIGS. 4 and 5 that are different from those of the filling device of FIGS. 2 and 3 will be described, the above description of the filling device of FIGS. 2 and 3 applying to all the remaining features.

With reference to FIGS. 4 and 5, in which parts and elements identical or corresponding to those of FIGS. 2 and 3 (prior art) have been assigned the same reference numerals, in the filling device 10 for filling machines according to the present invention the second closure member 66 is not arranged in the vicinity of the top end of the inner tube 26, but in the vicinity of the bottom end of the latter. To this end, the stem 78 of the piston 76 is provided with an extension formed by a rod 88, at the bottom end of which the second closure member 66 is placed. The rod 88 extends in the inner tube 26, coaxially therewith, and has an external diameter that is smaller than the internal diameter of this tube, whereby an annular conduit 90 (FIG. 5) is defined between the rod 88 and the inner tube 26. The rod 88, which is fixed to the stem 78 of the piston 76, is therefore free to slide inside the inner tube 26 and thus operate the second closure member 66, which is provided with a seal member 92 for sealing the annular conduit 90, to control opening/closing of the annular conduit 90, and hence of the inner tube 26.

According to the embodiment of FIGS. 4 and 5, in which both the first closure member 36 and the second closure member 66 are arranged in the vicinity of the bottom end of the inner tube 26, the first closure member 36 has a conical seat 94 with which the seal member 92 provided on the second closure member 66 is configured to cooperate.

Figure 6:
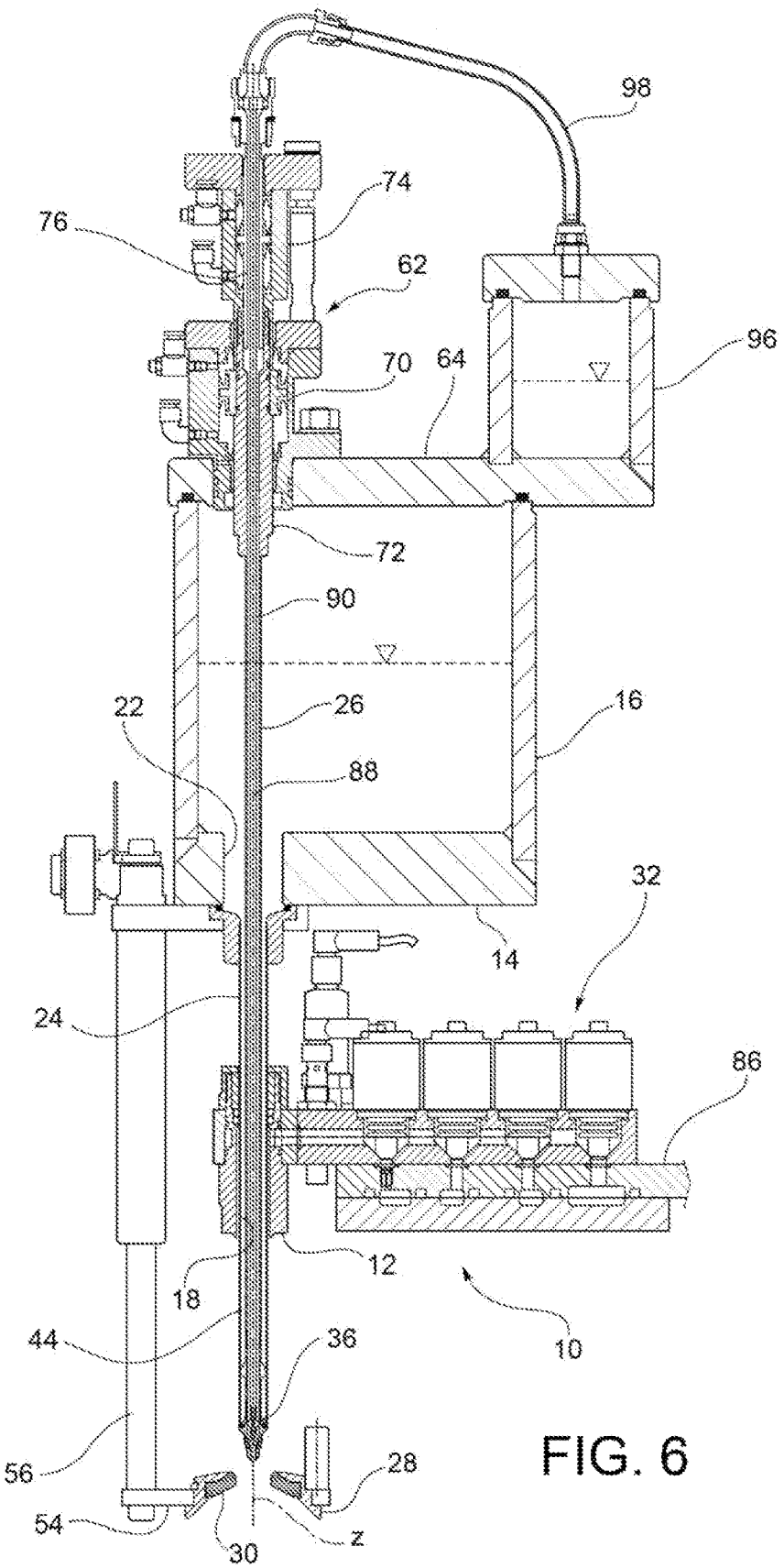
FIG. 6 is an axially sectioned view of a filling device for filling machines according to a variant of embodiment of the present invention, configured to work not only with non-gaseous and gaseous liquids, but also with viscous liquids.

FIG. 6, where parts and elements identical or corresponding to those of FIGS. 4 and 5 have been given the same reference numerals, shown a variant of embodiment of the above-described filling device which is configured to work not only with non-gaseous and gaseous liquids, but also with viscous liquids.

According to this variant of embodiment, the filling machine comprises, in addition to the above-described vessel 16, hereinafter referred to as primary vessel, a further vessel 96, hereinafter referred to as secondary vessel. The primary vessel 16 has the function of containing the liquid to be bottled, whereas the secondary vessel 96 has the function of collecting the recovered liquid, as will be explained better further on. In the example shown in FIG. 6, the secondary vessel 96 is made directly on the cover 64 of the primary vessel 16, but might also be completely distinct from the latter. A connecting tube 98 opens to the secondary vessel 96 and is connected to the inner tube 26, or better to the annular conduit 90, of the filling device 10. The first linear actuator (cylinder 68 and piston 70) and the second linear actuator (cylinder 74 and piston 76) of the filling device 10 are therefore suitably configured to be totally passed through by the annular conduit 90 to allow this latter to be connected to the connecting tube 98 and therefore to the secondary vessel 96.

In view of the above description, the advantages already mentioned above that are offered by a filling device for filling machines according to the present invention, namely the higher precision in the filling level obtained even without the emptying step, and the possibility to carry out more efficiently the degassing step with products difficult to work with, such as for example sparkling wine, beer, etc, are apparent.

Moreover, the use of a filling device according to the invention in combination with a filling machine provided with a primary vessel and a secondary vessel as described above by way of example with reference to FIG. 6 offers the following additional advantages.

First of all, the gas that is present inside the bottle and is expelled from the bottle during the filling step to leave space to the liquid to be bottled is not conveyed back into the primary vessel 16, but flows through the annular conduit 90 and the connecting tube 98 into the secondary vessel 96. The liquid droplets that during the filling step are sometimes swept along the annular conduit 90 by the gas flowing out of the bottle and, in a much more evident way, the small quantity of liquid that is present inside the annular conduit 90 at the end of the filling step and is expelled during the above-described emptying step, do not return back into the primary vessel 16 but are collected in the secondary vessel 96 to be used as the user prefers. Since these droplets or small amounts of liquid expelled from the bottle are collected in a special vessel separate from the primary vessel containing the liquid to be bottled, it is possible to reduce oxidation and improve sterility of the liquid to be bottled.

Secondly, by suitably managing the pressures in the primary and secondary vessels it is possible to carry out the classical isobaric filling, be it at a slight pressure or at high pressure (in other words, the two vessels are kept exactly at the same pressure and the liquid falls into the bottle by gravity), or the filling with a pressure difference. The pressure difference allows to increase the filling speed, and hence the performance of the machine, and to bottle viscous liquids as well.

Naturally, the principle of the invention remaining unchanged, the embodiments and the constructional details may be modified with respect to those described and illustrated purely by way of non-limiting examples, without thereby departing from the scope of the invention as described and claimed herein.

Figure 1:
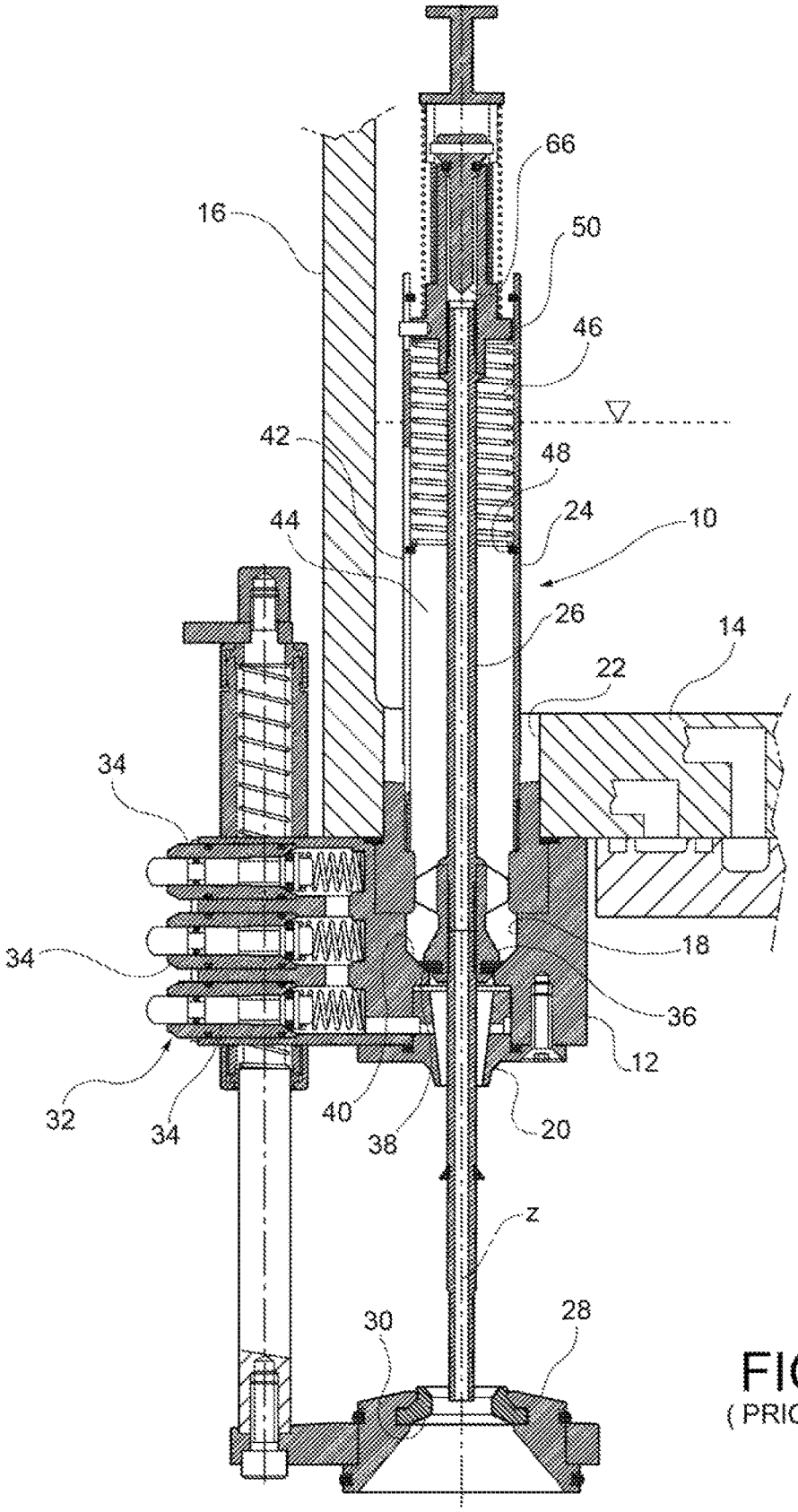
FIG. 1 ( PRIOR ART )
FIG. 1 is an axially sectioned view of a filling device for filling machines according to a first known embodiment.

For example, even though the invention has been described with reference to an embodiment in which not only the second closure member, but also the first closure member, are placed in the vicinity of the bottom end of the inner tube, it is also applicable to a filling device such as the one of FIG. 1, i.e. with the first closure member placed at an intermediate position along the inner tube.

The invention claimed is:

1. A filling device for filling machines for level filling of bottles comprising:

a body having an inner cavity which extends vertically through said body;

an outer tube configured for being fixed at the top to a bottom wall of a main vessel of a machine containing liquid with which the bottles are to be filled, the outer tube extending through the inner cavity of the body and projecting downward from the body;

an inner tube being arranged coaxially with the outer tube and extending with a lower portion thereof inside the outer tube and projecting upward from the outer tube, so as to reach with its top end, in the mounted condition of the filling device on the machine, a level higher than the level of the liquid contained in the main vessel, the outer tube and the inner tube encompassing a first annular conduit which extends up to the bottom end of the outer tube and through which the liquid contained in the main vessel can flow downward to fill a bottle;

a centring cone arranged coaxially with the outer tube and the inner tube configured to seal against the top end of the neck of the bottle to be filled;

a first closure member arranged to be vertically movable relative to the outer tube and configured to sealingly close the first annular conduit;

a second closure member arranged to be vertically movable relative to the inner tube and configured to sealingly close the inner tube; and an actuation unit for controlling the vertical movement of the first closure member and of the second closure member;

wherein the second closure member is placed at the bottom end of the inner tube to open/close said tube at the bottom, and is fixed to the bottom end of a sliding rod which extends within the inner tube, coaxially therewith, and defines with the inner tube a second annular conduit, and wherein the actuation unit controls the vertical movement of the sliding rod, and of the second closure member therewith, relative to the inner tube.

2. The device of claim 1, wherein the first closure member is also positioned at the bottom end of the inner tube and cooperates with the bottom end of the outer tube to open/close the first annular conduit at the bottom.

3. The device of claim 2, wherein the first closure member has a conical seat and wherein the second closure member is provided with a seal member which cooperates with the conical seat.

4. The device of claim 1, wherein the actuation unit comprises a first linear actuator for controlling the vertical movement of the first closure member and a second linear actuator for controlling the vertical movement of the second closure member.

5. The device of claim 4, wherein the first linear actuator and the second linear actuator are mounted in series with each other.

6. The device of claim 4, wherein the first linear actuator and the second linear actuator are double-acting pneumatic cylinders.

7. A filling machine for level-filling of bottles comprising a main vessel for containing liquid to be bottled and a plurality of the filling devices of claim 1, wherein the inner tube of each filling device extends inside the main vessel through a respective hole provided in a bottom wall of the main vessel.

8. The filling machine of claim 7, further comprising a secondary vessel which is separate from the main vessel and is in fluid communication with the inner tube of each filling device.

* * * * *